United States Patent [19]

Singleton

[11] Patent Number: 4,680,099

[45] Date of Patent: Jul. 14, 1987

[54] ELECTROPLATING APPARATUS

[76] Inventor: Raymund Singleton, 31653 Electric Blvd., Avon Lake, Ohio 44012

[21] Appl. No.: 848,942

[22] Filed: Apr. 7, 1986

[51] Int. Cl.[4] ..... C25D 17/20

[52] U.S. Cl. ..... 204/213

[58] Field of Search ..... 204/213

[56] References Cited

U.S. PATENT DOCUMENTS

| | | | |
|---|---|---|---|
| 1,853,297 | 4/1932 | Bristow | 204/213 |
| 2,766,201 | 10/1956 | Luther | 204/213 |
| 3,042,592 | 7/1962 | Schaer | 204/51 |
| 3,152,060 | 10/1964 | Belke | 204/213 |
| 3,256,170 | 6/1966 | Neilson | 204/213 |
| 3,272,729 | 9/1966 | Jumer | 204/140.5 |
| 3,330,753 | 7/1967 | Hepfer | 204/213 |
| 3,359,195 | 12/1967 | Hojyo | 204/212 |
| 3,379,631 | 4/1968 | Henig | 204/213 |
| 3,425,926 | 2/1969 | Hojyo | 204/213 |
| 3,634,211 | 1/1972 | Seyb | 204/51 |
| 3,654,101 | 4/1972 | Aoun | 204/51 |
| 3,699,015 | 10/1972 | Wisdom | 204/35 R |
| 3,830,711 | 8/1974 | Kedward | 204/43 T |
| 3,934,548 | 1/1976 | Kaluza | 118/418 |
| 3,954,574 | 5/1976 | Gyllenspetz | 204/43 T |
| 4,054,494 | 10/1977 | Gyllenspetz | 204/43 T |
| 4,102,771 | 7/1978 | Honig | 204/299 EC |
| 4,105,526 | 8/1978 | Lewellen | 204/213 |
| 4,162,951 | 7/1979 | Tscherwitschke | 204/213 |
| 4,170,191 | 10/1979 | Juve | 118/705 |
| 4,305,804 | 12/1981 | Tipton | 204/213 |
| 4,378,274 | 3/1983 | Childs | 204/23 |
| 4,390,399 | 6/1983 | McInnes | 204/32 R |
| 4,401,542 | 8/1983 | Zamiska | 204/213 |
| 4,445,993 | 5/1984 | Stutz | 204/213 |

*Primary Examiner*—Donald R. Valentine

*Attorney, Agent, or Firm*—Fay, Sharpe, Beall, Fagan, Minnich & McKee

[57] ABSTRACT

An electroplating apparatus includes a perforate work barrel adapted to be placed in a tank containing a plating electrolyte requiring high current levels to effectuate plating. At least four danglers of high-current capacity, insulated copper wire have one end thereof extending through a side wall of the work barrel, at an axis about which the barrel may rotate. The danglers are uniformly placed along the interior of the work barrel and at a uniform distance from a longitudinal wall interconnecting the side walls. An electric motor slowly rotates the barrel with metallic objects to be electroplated placed therein. The objects are thereby placed in uniform electrical connection to an exposed end of the danglers.

3 Claims, 3 Drawing Figures

ELECTROPLATING APPARATUS

BACKGROUND OF THE INVENTION

This invention pertains to the art of electroplating and more particularly to electroplating with high power requirements such as is necessary for the application of chromium.

It is well-known that depositing coatings of such materials as brass, nickle, chromium or zinc reduces corrosion and improves appearance of articles. The current practice includes placing the articles or workpieces to be plated into a rotating drum or work barrel which is in turn placed in an electrolyte comprising the appropriate plating substance. The articles are electrically connected to a cathode terminal of a power supply. Several varieties of cathodes have been implemented. A preferred variety is a dangler-type cathode conductor which is placed into the drum assembly. The corresponding anode of the power supply, being the opposite pole to that of the danglers, is applied to the electrolyte thereby completing an electrical circuit and causing migration of the plating ions to the objects to be plated. Significantly higher current densities are necessary with materials such as chromium. The work barrel is rotated to allow all articles therein to come into contact with the dangler assemblies, allowing for uniform plating of substantially all of them as well as keeping the electrolyte circulating into the plating barrel in a relatively homogeneous mixture.

In practice, the current density varies across the surface of the workpiece. However, effective plating with chromium occurs only within the range of current densities between 5 and 1000 amps/ft.$^2$. The ability of a plating solution to produce bright deposits over a range of current density is called its covering power, and the ability to deposit metal of even thickness at different current densities is called throwing power. Due to the positive slope of the current density-plating thickness curve, more metal is deposited on high current areas such as edges than is necessary for production. In certain areas of the workpieces, deposition of chromium in a non-decorative, roughened and tarnished form, known as burning, appears due to poor throwing power.

The apparatus of the present invention is particularly applicable to suitable high current chromium plating apparatus and will be described with particular reference thereto, although it will be appreciated that the invention has broader applications, such as the prevention of burning through more uniform power distribution to the workpieces.

SUMMARY OF THE INVENTION

The present invention contemplates a new and improved electroplating apparatus which overcomes all the above-referenced problems and others and provides a means for electroplating in a high current electrolyte, which is simple, economical, and provides a more uniform finish.

In accordance with the present invention, there is provided a perforated work barrel having first and second side walls disposed opposite one another and interconnected by a longitudinal wall. The work barrel is adapted to receive articles to be electroplated or workpieces, and is further adapted to be contained in an associated tank. An electric motor or means causes rotation of the barrel about its longitudinal axis. At least four danglers are provided to carry high electric current to objects to be plated in the barrel. The danglers enter the plating barrel through the side walls, at substantially the center thereof. The danglers enter the plating barrel in a direction substantially parallel to the longitudinal axis, and taper downward, radially outward of the longitudinal axis. When connected to this way, the barrel may freely rotate without interference from the stationary danglers.

In accordance with another aspect of the present invention, the danglers are also spaced generally uniformly along the longitudinal axis, at a generally uniform distance from the longitudinal wall.

In accordance with a more limited aspect of the invention, the electroplating apparatus is adapted to be selectively raised and lowered into an associated tank whereby workpieces may be placed in the work barrel for plating and removed therefrom upon completion.

In accordance with a yet more limited aspect of the present invention, the danglers are comprised of conductive, insulated cable, generally cylindrical in shape and are adapted to carry an aggregate electrical current in excess of 1,000 amperes.

In accordance with a still more limited aspect of the present invention, a tank is provided to receive the work barrel and contains a high current requiring electrolyte such as a chromium compound.

The principal object of the invention is the provision of an apparatus for providing uniform exposure to electrical current for objects to be plated.

A second object of the present invention is the provision of an electroplating apparatus adapted to function with high current densities.

Another object of the invention is to minimize arcing between danglers and components to be plated by increasing the number of electrical connections therebetween.

Other objects and advantages will become apparent upon a reading and understanding the accompanying specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
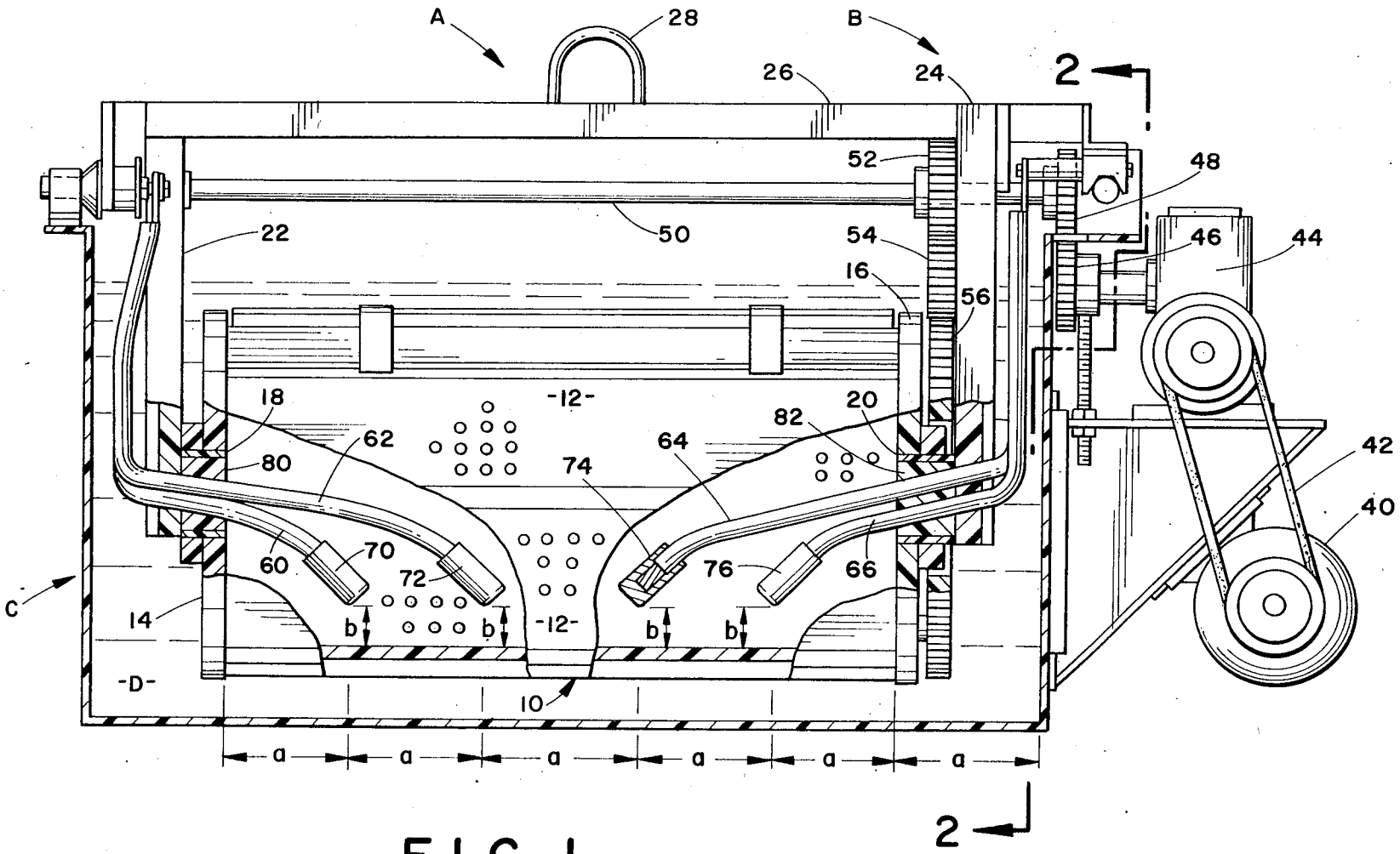
FIG. 1 is a front view of the electroplating apparatus of the present invention.

Referring now to the drawings wherein the showings are for the purposes of illustrating the preferred embodiment of the invention only and not for purposes of limiting the same, FIG. 1 shows a side view of the electroplating apparatus of the present invention. The electroplating apparatus A includes a plating mechanism B and an electrolyte tank C containing electrolyte D.

Figure 2:
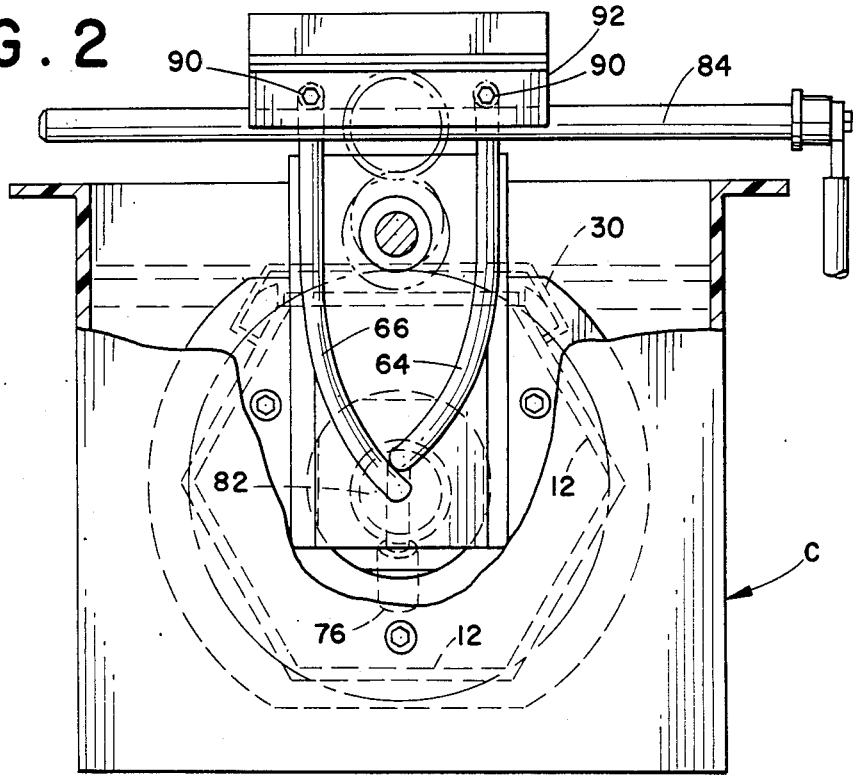
FIG. 2 is a sectional view taken along line 2—2 of FIG. 1.
Figure 3:
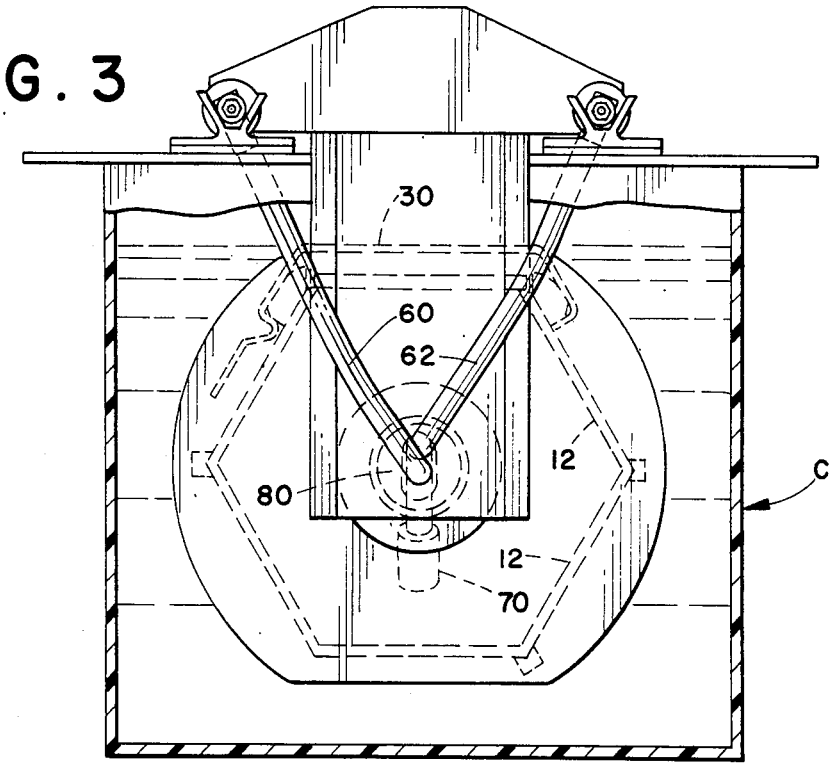
FIG. 3 is an opposite side view to FIG. 2 with portions removed for ease of illustration.

The plating mechanism B includes a work barrel 10 comprised of perforate longitudinal walls 12 interconnecting a hexagonal first side wall 14 and a hexagonal second side wall 16 at a generally perpendicular angle thereto. In the preferred embodiment, the work barrel 10 is comprised of six longitudinal walls 12 interconnecting the respective edges of the first and second side walls (FIGS. 2 and 3). The longitudinal walls 12 are comprised of perforate panels adapted to allow the free flow of electrolyte therethrough and are preferably constructed of a non-conductive, plastic material. A door is provided, as described further below, in a longitudinal wall to allow for the selective ingress and egress of objects into and out of the work barrel 10. Although the drawings illustrate a hexagonal work barrel, it is to be appreciated that a single longitudinal wall comprised of a perforate panel bent to an arcuate form may be substituted therefor. A hexagonal form is preferred insofar as internal corners thereof allow for more thorough agitation of objects to be plated when the work barrel is rotated during the plating process in a fashion as will be discussed further below.

The work barrel 10 is pivotally mounted at the side walls 14 and 16 by bearings 18, 20 to a first vertical support 22 and a second vertical support 24, respectively. When so mounted, the work barrel 10 is able to rotate about its longitudinal axis while being suspended from the supports 22 and 24. The vertical supports 22 and 24 are mounted to a cross piece 26 which functions to keep the vertical support 22 and 24 at a relatively uniform separation therebetween. A mounting bracket 28 is secured to the cross piece 26 at substantially the center of gravity of the plating mechanism B to allow for raising and lowering of the plating mechanism into or out of the electrolyte tank C. This may be accomplished by use of hoist or crane.

An electric motor 40 is mechanically connected by a belt or chain 42 to a right angled gear drive 44. The gear drive 44 in turn connects, through a series of gears 46 and 48, a shaft 50, which in turn drives gears 52, 54, and 56, the latter of which is mounted to the side wall 16. Rotation of the work barrel 10 can then be accomplished by selectively engaging the electric motor 40, and the desired rotational velocity of the work barrel 10 may be varied by manipulation of gear ratios.

The plating function is accomplished by exposing objects to be plated to one pole or cathode of an associated electrical power supply (not shown), and immersing them into an electrolyte solution to which the opposite pole is exposed. In the present invention, the objects or workpieces are placed into the work barrel 10. A plurality of danglers 60, 62, 64, 66 function to electrically connect the objects to be plated to the power supply cathode. Each dangler is comprised of a generally cylindrical, heavy, stranded, rubber or plastic insulated cable with a suitable, contactor assembly or end cap 70, 72, 74 and 76. The cables and end caps are able to carry sufficient current to maintain a current density on the surface of workpieces generally in the range between 5 and 1,000 amps/ft.$^2$ necessary to allow for chromium plating. The danglers are of sufficient rigidity to generally maintain their positioning during a plating procedure when they are contacting objects in the rotating work barrel. The danglers will thereby maintain a generally downward direction and not migrate appreciably upward with workpieces in the rotating work barrel, notwithstanding virtually constant impinging contact therewith. The opposite pole or anode of the power supply is brought into contact with the electrolyte solution D to complete the electrical circuit.

The present invention is adapted to be used with high current requiring electrolytes, such as that necessary for chromium plating techniques. The danglers are provided to supply the high current or throwing power necessary to effect plating with such materials. The danglers 60, 62, 64, and 66 are placed in the work barrel 10 at generally uniform distances a from the side walls 14, 16, and along the longitudinal axis, to effectuate minimum current paths between objects to be plated within the barrel 10 and the danglers. To effectuate the high current or throwing power required in the instant invention, at least four danglers are implemented to contact the objects to be plated. Two danglers, 60 and 62, extend into the work barrel 10 through the first side wall 14, and two danglers, 64, 66, extend into the work barrel through the second side wall 16. The danglers 60 and 62 extend through an opening 80 in the central portion of bearing 18. Similarly, danglers 64 and 66 extend through an opening 82 in the central portion of bearing 20. When the positioning of the danglers into the work barrel 10 is so accomplished, the work barrel 10 may pivot about its longitudinal axis substantially unimpeded by the presence of the danglers. A first and second free end of each of dangler cables 60 and 62 enter the bearing opening 80 at a slight entrance angle but generally along the longitudinal axis of the work barrel 10. Free ends of danglers 64 and 66 enter bearing opening 82 similarly. As the danglers extend further inward of the barrel, the angle is generally increased radially outward from the longitudinal axis, resulting in a generally uniform displacement of the end caps 70, 72, 74 and 76 from longitudinal walls 12 as noted by the distance b. The danglers terminate at end caps 70, 72, 74, and 76 which are disposed to maintain a generally equivalent angle to the longitudinal axis of the work barrel. The termination angle is greater than the entrance angle and generally approximately 45° to the longitudinal axis when at the rest position illustrated, but will be varied during contact of the danglers with the workpieces during the plating process.

When spaced in the aforenoted manner, the danglers provide a more even distribution of high current to the objects to be plated placed within the work barrel 10.

In FIG. 2, the positioning of a door 30 into work barrel 10 is shown. This door allows for the placement of objects to be plated into the work barrel. The door is adapted to be secured closed during the plating process to prevent the loss of objects during rotation of the barrel.

In FIGS. 2 and 3, the relative positioning of the danglers in a plane perpendicular to that of the work barrel longitudinal axis can be noted. The danglers 64 and 66 are connected by lugs 90 and a fastener means such as a screw to a conductive member 92, which forms a complete current path with a fixed conductive cross piece 94, which is in turn connected to a power source. It will be noted that the danglers 64 and 66 begin in primarily a vertical position, as viewed in FIG. 2, angling toward the longitudinal axis of the work barrel 10 prior to entrance of the work barrel through the bearing opening 82.

Turning to FIG. 3, the danglers 60 and 62 enter the opening 80 analogously to the danglers 64 and 66, except that the wires thereof maintain a relatively constant angle inward toward the longitudinal axis of the work barrel 10 as taken from the mounting lugs 96.

Implementation of a typical plating operation using the above described invention would be as follows. A crane or hoist grasps the electroplating apparatus A at mounting bracket 28. The electroplating apparatus A at this time is removed from the associated electrolyte containing tank C. A door is opened providing ingress to the work barrel 10 for placement workpieces therein. After such parts have been placed in the work barrel, the door is closed and the work barrel is lowered by means of the crane into the electrolyte tank C. At this time, the motor 40 is activated causing rotation of the work barrel 10 and, accordingly, agitation of the objects to be plated therein. An electric current is then induced through the danglers 60, 62, 64 and 66, and thereby charges the workpieces through contact of the danglers to the plating pieces through end caps 70, 72, 74 and 76. When the work barrel 10 is rotated, all pieces to be plated are continuously exposed to a relatively uniform high current field by repeated rotation and exposure to one of the danglers or by conduction through other workpieces. The presence of the electric current causes migration of the plating ions to the workpieces. After sufficient plating has occurred, the electric current is removed from the danglers and the crane is again used to remove the plating mechanism B from the electrolytic tank C. At this time the door is opened and the fully plated articles are removed therefrom.

The invention has been described with reference to a preferred embodiment. Obviously, modifications and alterations will occur upon the reading and understanding of this specification. It is my intention to include all such modifications and alterations insofar as they come within the scope of the appended claims or the equivalents thereof.

Having thus described my invention, I claim:

1. An electroplating apparatus comprising:

a work barrel having a first side wall and a second side wall and a longitudinal wall connected to said side walls with at least one of said walls being constructed of a perforate panel, said barrel being pivotal upon a longitudinal axis thereof, adapted to receive articles to be electroplated therein and further adapted to be contained in an associated tank;

a means for causing rotation of said barrel about said longitudinal axis; and, at least four danglers of conductive, insulated cable for carrying an electrical current, said danglers having fixed ends located outside said barrel and electrically connected to and pivotal about a fixed conductor, said danglers having free ends extending through side walls of said barrel at generally said longitudinal axis, said free ends having an entrance angle to said longitudinal axis so that said danglers remain substantially free of interference from said side walls when said side walls are rotated with said barrel, each of said free ends terminating radially outward of said longitudinal axis at a termination angle approximating 45° to said longitudinal axis, said danglers geing longitudinally positioned generally uniformly within said work barrel and at a generally uniform distance from said longitudinal wall, said danglers including a contactor assembly adapted to contact and provide an electrical path to articles in said barrel as said barrel is rotated about its longitudinal axis.

2. An electroplating apparatus comprising:

a generally cylindrical work barrel having perforate walls permitting fluid throughflow to a barrel interior, said barrel adapted to be rotated about a longitudinal axis thereof and further adapted to receive associated workpieces in said interior for electrolytic treatment in an associated tank;

means for rotating said barrel about said longitudinal axis; and, first, second, third, and fourth stationary danglers adapted to carry electrical power to said barrel interior, said danglers being equispaced longitudinally along said barrel interior and being spaced a generally constant dimension from said walls for maximizing electrical contact with the associated workpieces whereby the associated workpieces are agitated by impinging contact with said danglers and the rotary action of said barrel.

3. An electroplating apparatus adapted to electroplate associated workpieces received therein, said apparatus comprising:

a generally cylindrical barrel having opposed first and second side walls and a perforate longitudinal wall extending therebetween, said barrel having an opening in said longitudinal wall adapted to receive the associated workpieces into an interior of said barrel;

means for rotating said barrel;

first, second, third, and fourth danglers extending from said side walls into said barrel interior, said first and second danglers extending through said first side wall and said third and fourth danglers extending through said second side wall to said barrel interior, said danglers generally equispaced longitudinally in said barrel and each dangler spaced from said longitudinal wall a generally uniform first dimension whereby an even distribution of current is provided to the associated workpieces received in said barrel.

* * * * *